US008539626B2

(12) United States Patent
Dunne et al.

(10) Patent No.: US 8,539,626 B2
(45) Date of Patent: Sep. 24, 2013

(54) CRIB LINER

(75) Inventors: Debra Dunne, Compton, CA (US); Nanci Freeman, Compton, CA (US)

(73) Assignee: Crown Crafts Infant Products, Inc., Gonzales, LA (US)

( * ) Notice: Subject to any disclaimer, the term of this patent is extended or adjusted under 35 U.S.C. 154(b) by 0 days.

(21) Appl. No.: 13/381,012

(22) PCT Filed: Sep. 21, 2011

(86) PCT No.: PCT/US2011/052443

§ 371 (c)(1), (2), (4) Date: Dec. 27, 2011

(87) PCT Pub. No.: WO2012/177273

PCT Pub. Date: Dec. 27, 2012

(65) Prior Publication Data

US 2012/0317721 A1 Dec. 20, 2012

Related U.S. Application Data

(60) Provisional application No. 61/498,930, filed on Jun. 20, 2011.

(51) Int. Cl.
*A47D 15/00* (2006.01)
*A47D 7/00* (2006.01)

(52) U.S. Cl.
USPC ..... 5/663; 5/424; 5/93.1

(58) Field of Classification Search
USPC ..... 5/93.1, 663, 946, 100, 424, 425; 248/345.1
See application file for complete search history.

(56) References Cited

U.S. PATENT DOCUMENTS

| | | | | |
|---|---|---|---|---|
| 2,128,978 | A * | 9/1938 | Akin | 5/93.1 |
| 3,018,492 | A | 1/1962 | Rosen | |
| 3,241,158 | A | 3/1966 | Berl et al. | |
| 4,800,600 | A | 1/1989 | Baum | |
| 5,410,765 | A | 5/1995 | Youngblood | |
| 5,881,408 | A | 3/1999 | Bashista et al. | |
| 6,178,573 | B1 * | 1/2001 | Wagner et al. | 5/424 |
| 6,256,813 | B1 | 7/2001 | Aaron | |
| 6,564,403 | B1 * | 5/2003 | Titus | 5/425 |
| 6,957,464 | B1 | 10/2005 | Coauette | |
| 7,055,192 | B2 | 6/2006 | Waters et al. | |
| 7,523,513 | B2 | 4/2009 | Waters et al. | |
| 7,793,368 | B2 | 9/2010 | Burrell, IV | |
| 8,161,584 | B1 * | 4/2012 | Del Rio | 5/424 |

FOREIGN PATENT DOCUMENTS

WO WO 2004/056237 7/2004

* cited by examiner

*Primary Examiner* — Michael Trettel
(74) *Attorney, Agent, or Firm* — Roy Kiesel Ford Doody & Thurmon APLC

(57) ABSTRACT

A crib liner and method of lining an infant crib are provided that greatly reduce the risk of an infant injury resulting from an infant's arm or legs extending through the slats or rails or a crib. The crib liner is provided with a plurality of panels that can have a perforated section and a cushioned section. The plurality of panels may be separated into individual panels by a plurality of stabilizers. The crib liner may be attached to the crib by at least one fastener. The fastener may be located in any area that allows the crib liner to be removably secured attached to the crib.

8 Claims, 6 Drawing Sheets

100
101
101a
101b
101c
102
103
104
105
106
107
108
109
110
111
112
1A
1B
1C
1D
1E

CRIB LINER

CROSS-REFERENCE TO RELATED APPLICATION

This application claims priority to U.S. Provisional Patent Application 61/498,930 filed on Jun. 20, 2011.

TECHNICAL FIELD

This invention relates to a liner for an infant's crib, particularly a liner that is soft, flexible and breathable, and covers a substantial portion of the inner side and end walls of a crib. The purpose of the liner is to protect the crib user from bumping against the generally rigid side or end walls (e.g. rails) of the crib and prevent the crib user from getting their arms, legs, hands, or fingers stuck between the rails of a crib. In addition, the liner allows air to circulate within the crib and is generally removably positioned relative to the rails of the crib with the aid of fasteners such as ties.

BACKGROUND ART

Over the years, crib related safety issues have become a paramount concern due to crib users being injured or killed after becoming lodged between the rails. In order to mitigate these safety concerns, several innovations have been developed.

One such innovation is a crib liner. Typically, the crib liner is constructed of a fabric material that extends along the inner periphery of the side and end walls of a crib thereby preventing the crib user from impacting the rails or becoming lodged between the rails. However, in many cases, crib liners do not have adequate structural support. As a result, the crib liner often sags or falls in the crib and does not fully cover the crib walls, which increases the risk that an infant may lodge their appendages between the crib rails.

These concerns have been addressed through a variety of improvements to crib liners. For example, U.S. Pat. No. 7,793,368 discloses a crib liner constructed of mesh panel sections. However, this crib liner only provides vertical supports at its corners. Therefore, a need exists for a more versatile crib liner that greatly reduces the risk of infant injury while also having adequate structural support.

DISCLOSURE OF THE INVENTION

The object of this invention is to provide a crib liner and a method of lining the walls of a crib that greatly reduces the risk of infant injury by protecting infants' arms and legs from becoming caught between the rails or slats of a crib while also preventing infants from dropping pacifiers or other items out of the crib. Another object of this invention is to provide a crib liner that keeps sleeping areas cool and comfortable. A further object of this invention is to provide a crib liner that possesses adequate structural support. Additional objects and advantages of this invention shall become apparent in the ensuing descriptions of the invention.

The crib liner includes at least one, but preferably a plurality of panels. Each panel is provided with at least one, but preferably with a plurality of stabilizers, which define the boundaries of the panels and separate the plurality of panels into individual panels.

Each individual panel has a top side, a bottom side, and end sides. The end sides are orthogonal to the top side and the bottom sides. At least one of the plurality of stabilizers may include one or more vertical stabilizers located on the sides of each individual panel. In addition, at least one of the plurality of stabilizers may also include one or more horizontal stabilizers located on either the top or bottom sides of each individual panel. In an alternative embodiment, the horizontal stabilizers may be provided on the top and bottom of each individual panel.

The plurality of panels may also include a cushioned section, a perforated section, and a bottom border section. The cushioned section is secured to the perforated section such that the cushioned section is parallel to the perforated section. The mesh is adequately perforated to allow air to circulate through the perforated section.

Another aspect of this invention is a method of lining an infant crib utilizing a crib liner as disclosed herein. The method comprises obtaining a sufficient plurality of crib liners to provide at least one crib liner for each wall of the infant crib. One of the plurality of crib liners is placed parallel to one of the crib walls of the infant crib. The crib liner is secured to the crib walls by at least one fastener, preferably multiple fasteners. The aforementioned steps are repeated until each wall of the infant crib is fitted with a crib liner.

BEST MODE FOR CARRYING OUT THE INVENTION

Figures 1, 1A, 1B, 1C, 1D, 1E:
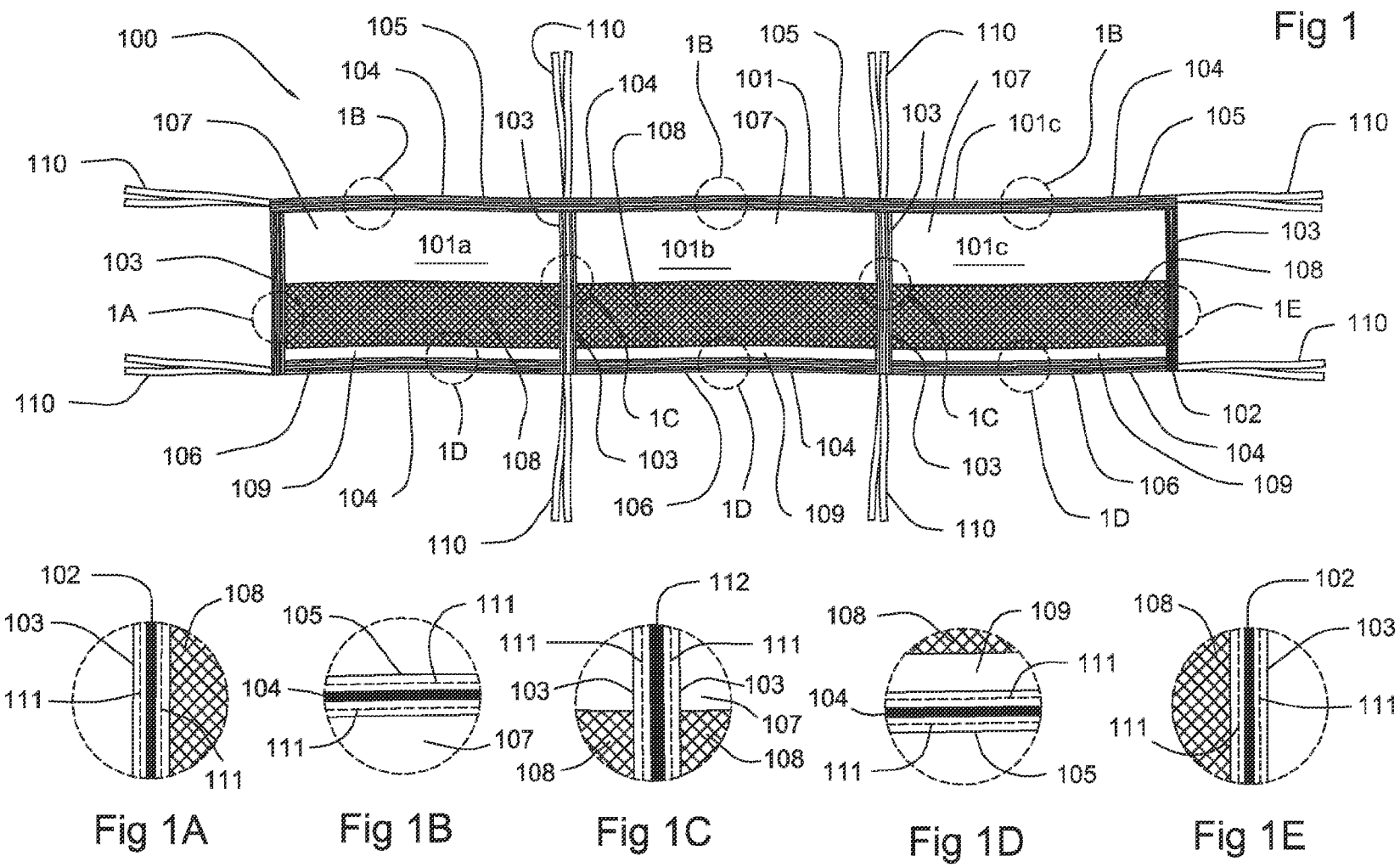
FIG. 1 is a front view of a side wall crib liner in accordance with this invention.
FIG. 1A is an enlarged view of the outer vertical stabilizer located on the end side of the crib liner.
FIG. 1B is an enlarged view of horizontal stabilizers located on the top side of each individual panel.
FIG. 1C is an enlarged view of the inner vertical stabilizers located on inner end sides of each individual panel comprising the plurality of panels.
FIG. 1D is an enlarged view of the horizontal stabilizers located on the bottom side of each individual panel.
FIG. 1E is an enlarged view of the outer vertical stabilizer located on the end side of the crib liner.

An embodiment of a side wall crib liner in accordance with this invention is shown generally in FIG. 1 at 100. The crib liner 100 comprises at least one, but preferably a plurality of panels 101*a*, 101*b*, 101*c*. Each panel 101*a*, 101*b*, 101*c* is provided with at least one, but preferably with a plurality of stabilizers, which may be located along the periphery of each individual panel comprising the plurality of panels. The plurality of stabilizers defines the boundaries of the panels and separates the plurality of panels into individual panels.

Each individual panel 101*a*, 101*b*, 101*c* has a top side 105, a bottom side 106, and end sides 103. The end sides 103 are substantially orthogonal to the top side 105 and the bottom side 106. At least one of the plurality of stabilizers may include one or more vertical stabilizers, such as boning stabilizers, located on the sides of each panel 103. The vertical stabilizers may be outer vertical stabilizers 102, which are located on the end sides of the crib liner. The vertical stabilizers may also be inner vertical stabilizers 112, which are located on the inner end sides of each individual panel comprising the plurality of panels.

In addition, at least one of the plurality of stabilizers may also include one or more horizontal stabilizers 104 located on the either the top 105 or bottom 106 sides of each individual panel. In an alternative embodiment, the horizontal stabilizers 104 are provided on the top 105 and bottom 106 of each individual panel. The plurality of stabilizers may be secured to the plurality of panels by pockets 111. The pockets are preferably located along the periphery of each panel, and the stabilizers can be located inside the pockets 111.

The plurality of panels may also include a cushioned section 107, a perforated section 108, and a bottom border section 109. If the panel includes a cushioned section 107, the cushioned section 107 is secured to the perforated section 108 such that the cushioned section 107 is parallel to the perforated section 108. In an embodiment of the present invention, the perforated section 108 is secured such that the perforated section 108 is parallel to the cushioned section 107 and below the cushioned section 107 as shown in FIG. 1.

The cushioned section 107 may comprise any material capable of protecting the crib user from injuries caused by bumping against crib walls. Suitable materials include, but are not limited to, foam rubber, natural down fill, synthetic down fill, cotton fill, or a combination of the above. In an embodiment of the present invention, the cushioned section 107 may also comprise a layer of fabric over a plush material. The layer of fabric may be an aesthetically pleasing décor fabric. The bottom border section 109 may be fused fabric.

The perforated section 108 may comprise a mesh. The mesh is adequately perforated to allow air to circulate through the perforated section 108. In addition, the mesh material must also be strong enough to withstand forceful contact from an infant. Suitable materials for the mesh material include, but are not limited to, nylon, cotton, lace, and rayon.

The crib liner 100 also includes at least one fastener 110, preferably a plurality fasteners 110. In the preferred embodiment, fasteners 110 may be located at the corners of each individual panel comprising the plurality of panels. The fasteners allow the crib liner to be generally removably and securely positioned relative to the inner walls of the crib. The fasteners 110 are preferably bias ties, but may also include any type of fastener capable of removably and securely attaching the crib liner 100 to a crib.

Figure 2:
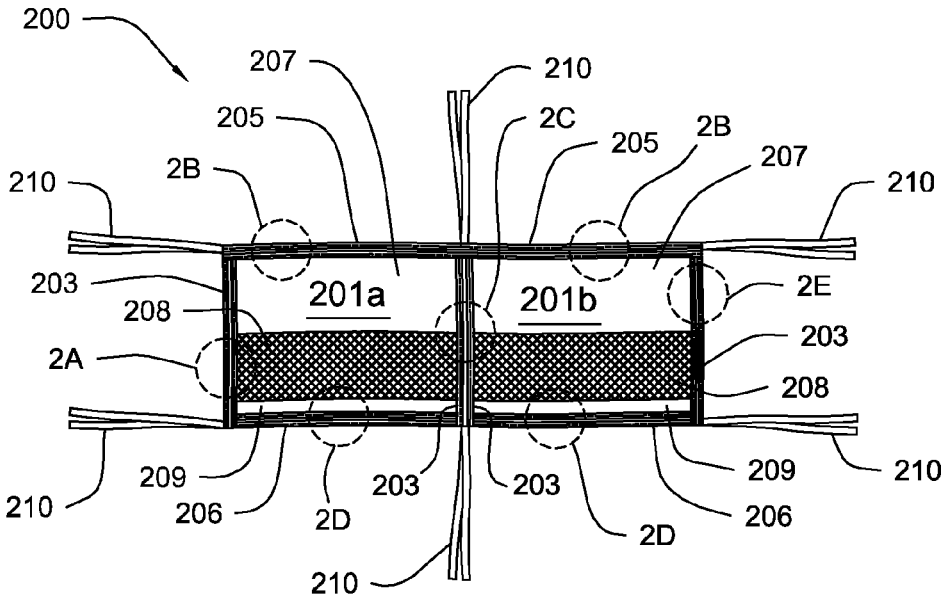
FIG. 2 is a front view of an end wall crib liner in accordance with this invention.
Figure 2A:
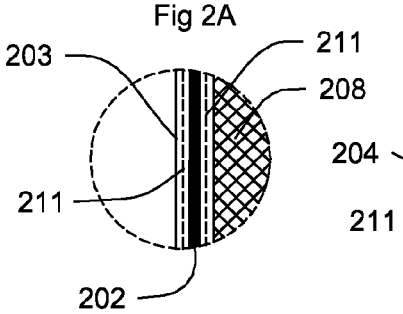
FIG. 2A is an enlarged view of the outer vertical stabilizer located on the end side of the crib liner.
Figure 2B:
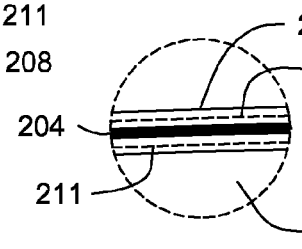
FIG. 2B is an enlarged view of horizontal stabilizers located on the top side of each individual panel.
Figure 2C:
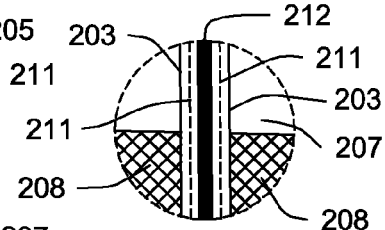
FIG. 2C is an enlarged view of the inner vertical stabilizer located on inner end sides of each individual panel comprising the plurality of panels.
Figure 2D:
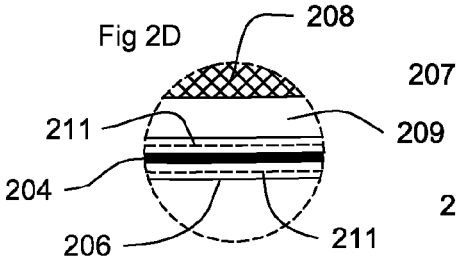
FIG. 2D is an enlarged view of the horizontal stabilizers located on the bottom side of each individual panel.
Figure 2E:
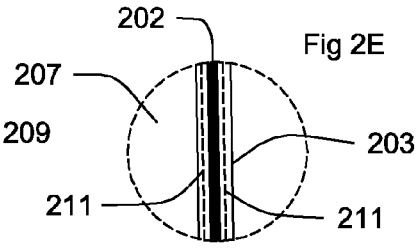
FIG. 2E is an enlarged view of the outer vertical stabilizer located on the end side of the crib liner.

An embodiment of an end wall crib liner in accordance with this invention is shown generally in FIG. 2 at 200. The crib liner 200 comprises at least one, but preferably a plurality of panels 201*a*, 201*b*. Each panel 201*a*, 201*b* is provided with at least one, but preferably with a plurality of stabilizers, which may be located along the periphery of each individual panel comprising the plurality of panels. The plurality of stabilizers defines the boundaries of the panels and separates the plurality of panels into individual panels.

Each individual panel 201*a*, 201*b* has a top side 205, a bottom side 206, and end sides 203. The end sides 203 are substantially orthogonal to the top side 205 and the bottom side 206. At least one of the plurality of stabilizers may include one or more vertical stabilizers, such as boning stabilizers, located on the sides of each panel 203. The vertical stabilizers may be outer vertical stabilizers 202, which are located on the end sides of the crib liner. The vertical stabilizers may also be inner vertical stabilizers 212, which are located on the inner end sides of each individual panel comprising the plurality of panels.

In addition, at least one of the plurality of stabilizers may also include one or more horizontal stabilizers 204 located on the either the top 205 or bottom 206 sides of each individual panel. In an alternative embodiment, the horizontal stabilizers 204 are provided on the top 205 and bottom 206 of each individual panel. The plurality of stabilizers may be secured to the plurality of panels by pockets 211. The pockets are preferably located along the periphery of each panel, and the stabilizers can be located inside the pockets 211.

The plurality of panels may also include a cushioned section 207, a perforated section 208, and a bottom border section 209. If the panel includes a cushioned section 207, the cushioned section 207 is secured to the perforated section 208 such that the cushioned section 207 is parallel to the perforated section 208. In an embodiment of the present invention, the perforated section 208 is secured such that the perforated section 208 is parallel to the cushioned section 207 and below the cushioned section 207 as shown in FIG. 2.

The cushioned section 207 may comprise any material capable of protecting the crib user from injuries caused by bumping against crib walls. Suitable materials include, but are not limited to, foam rubber, natural down fill, synthetic down fill, cotton fill, or a combination of the above. In an embodiment of the present invention, the cushioned section 207 can also comprise a layer of fabric over a plush material. The layer of fabric may be an aesthetically pleasing décor fabric. In an alternative embodiment, the cushioned section 207 may be constructed of fused fabric instead of cushioning. The bottom border section 209 may be fused fabric.

The perforated section 208 may comprise a mesh. The mesh is adequately perforated to allow air to circulate through the perforated section 208. In addition, the mesh material must also be strong enough to withstand forceful contact from an infant. Suitable materials for the mesh material include, but are not limited to, nylon, cotton, lace, and rayon.

The crib liner 200 also includes at least one fastener 210, preferably a plurality fasteners 210. In the preferred embodiment, the fasteners 210 may be located at the corners of each individual panel comprising the plurality of panels. The fasteners 210 allow the crib liner to be generally removably and securely positioned relative to the inner walls of the crib. The fasteners 210 are preferably bias ties, but may also include any type of fastener capable of removably and securely attaching the crib liner 200 to a crib.

Figure 3:
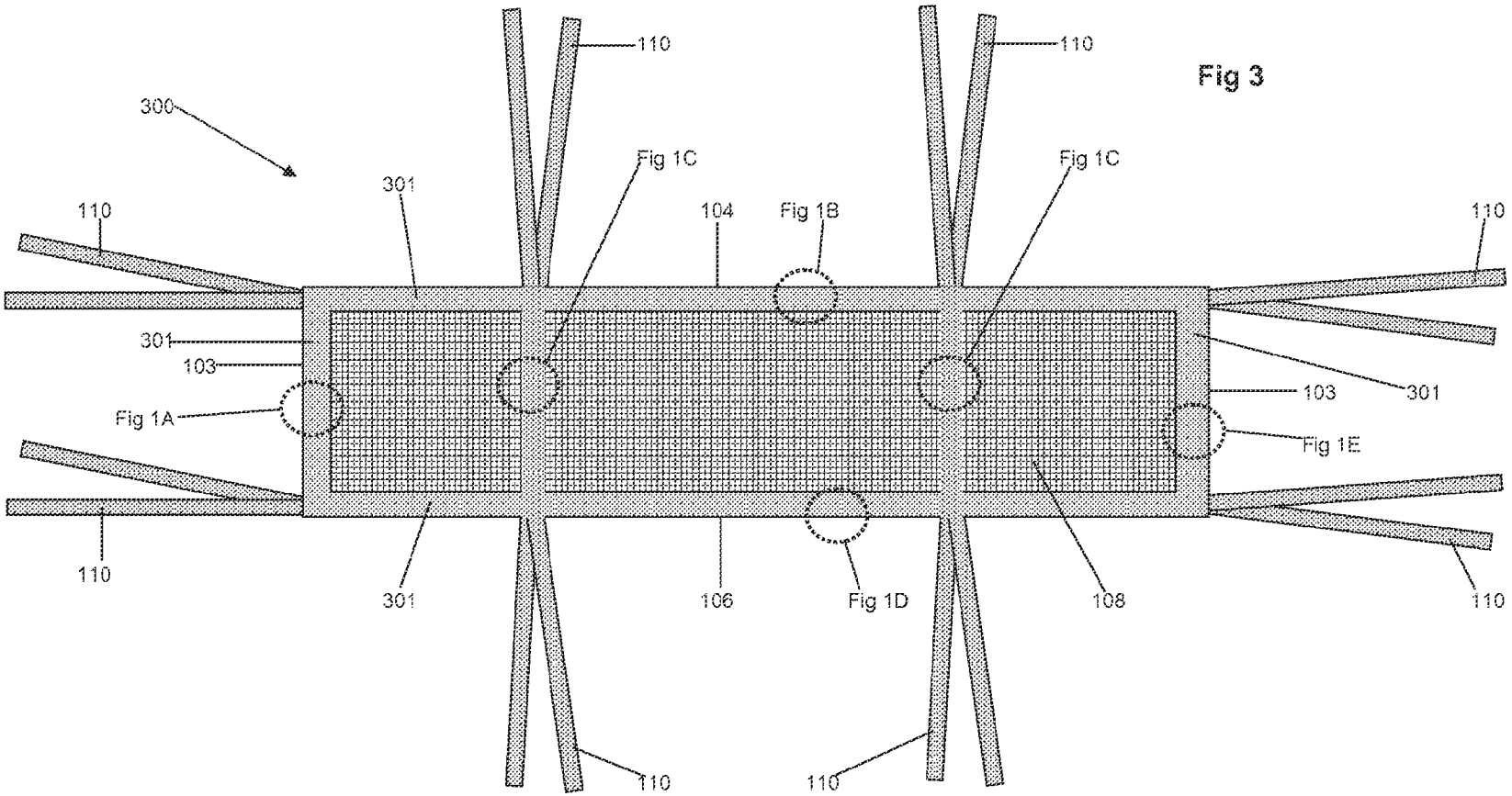
FIG. 3 is a back view of a crib liner without a cushioned section in accordance with this invention.

In an alternative embodiment as shown in FIG. 3, the crib liner 300 does not include a cushioned section. FIG. 3 is a front view of the crib liner 300 for a side wall of a crib. The crib liner comprises a perforated section 108 and a border section 301. The border section 301 may be constructed of fused fabric. The crib liner 300 may be sized accordingly to fit the walls of cribs, cradles, portable cribs, and so forth.

Figure 4:
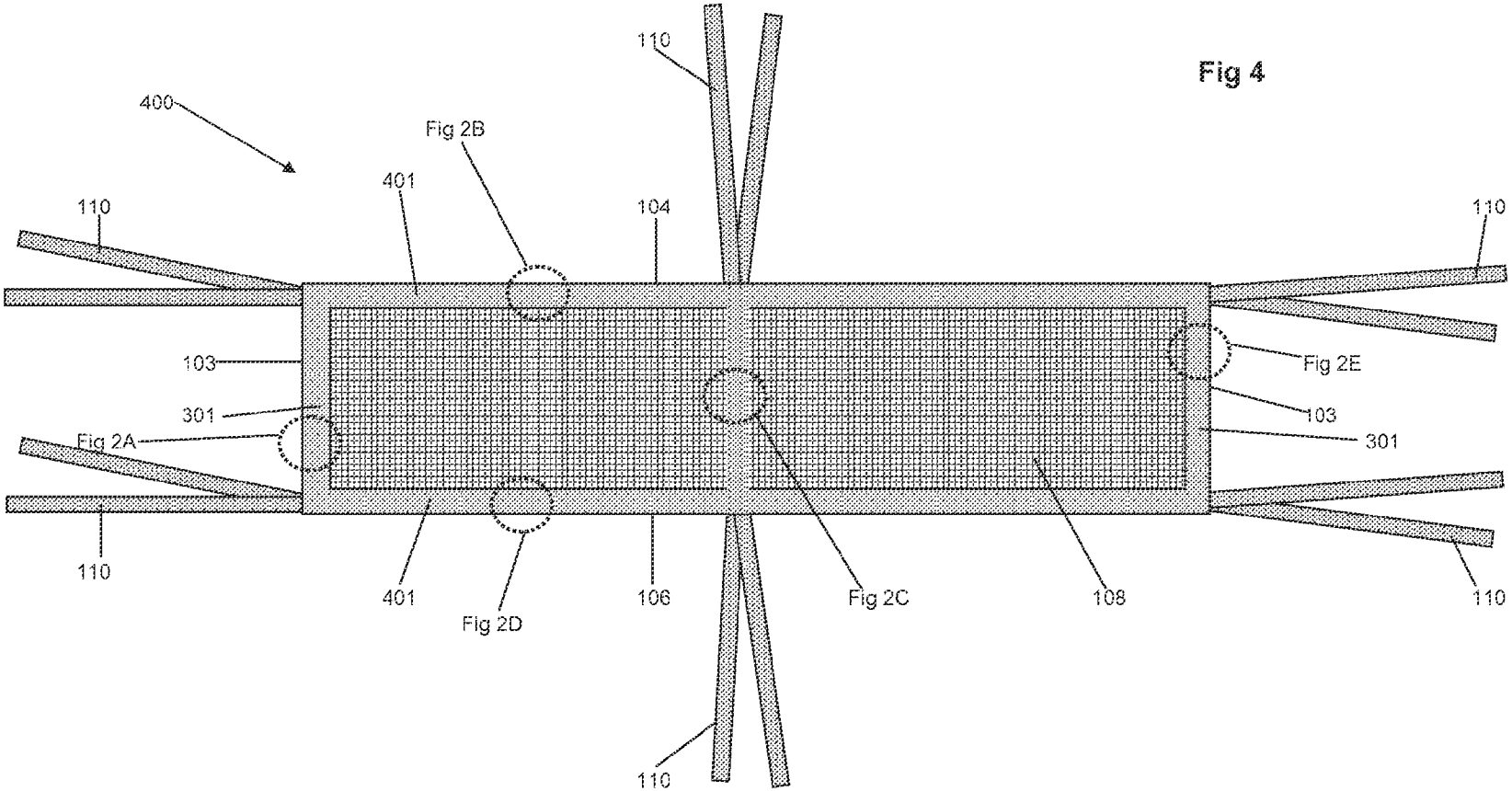
FIG. 4 is a front view of a crib liner without a cushioned section in accordance with this invention.

In an alternative embodiment as shown in FIG. 4, the crib liner 400 does not include a cushioned section. FIG. 4 is a front view of the crib liner 300 for an end wall of a crib. The crib liner comprises a perforated section 108 and a border section 401. The border section 401 may be constructed of fused fabric. The crib liner 400 may be sized accordingly to fit the walls of cribs, cradles, portable cribs, and so forth.

Figure 5:
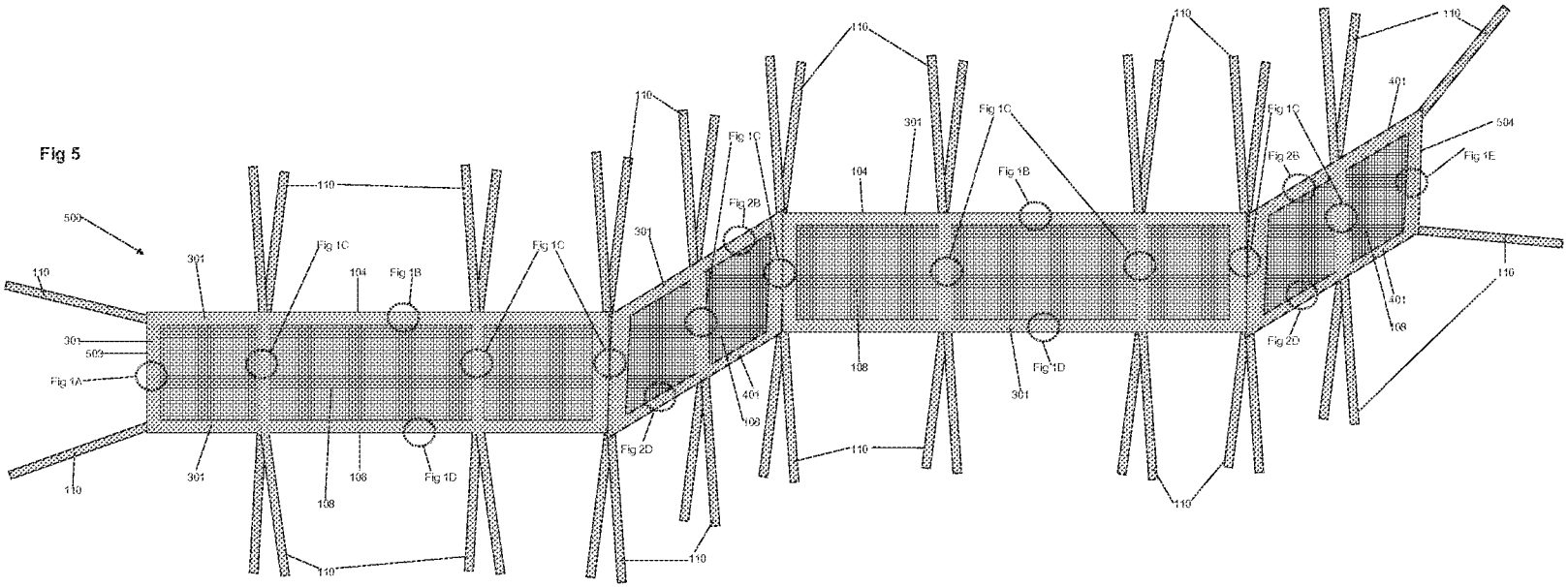
FIG. 5 is a front view of a continuous crib liner in accordance with this invention.

In another alternative embodiment as shown in FIG. 5, the crib liner may be a continuous crib liner 500 that connects together at the side ends of the panels. The crib liner 500 shown in FIG. 5 is depicted shown disconnected from the ends of the crib liner 503, 504. However, the ends of the crib liner 503, 504 may be secured together to form a single continuous crib liner. Each panel is provided with at least one, but preferably with a plurality of stabilizers, which may be located along the periphery of each individual panel comprising the plurality of panels. The plurality of stabilizers defines the boundaries of the panels and separates the plurality of panels into individual panels.

The crib liner may also comprise a platform base configured to connect to the crib liner panels, preferably the bottom of the panes, to form one continuous crib liner that may be placed under a crib mattress and also cover all the walls of a crib.

Figure 6:
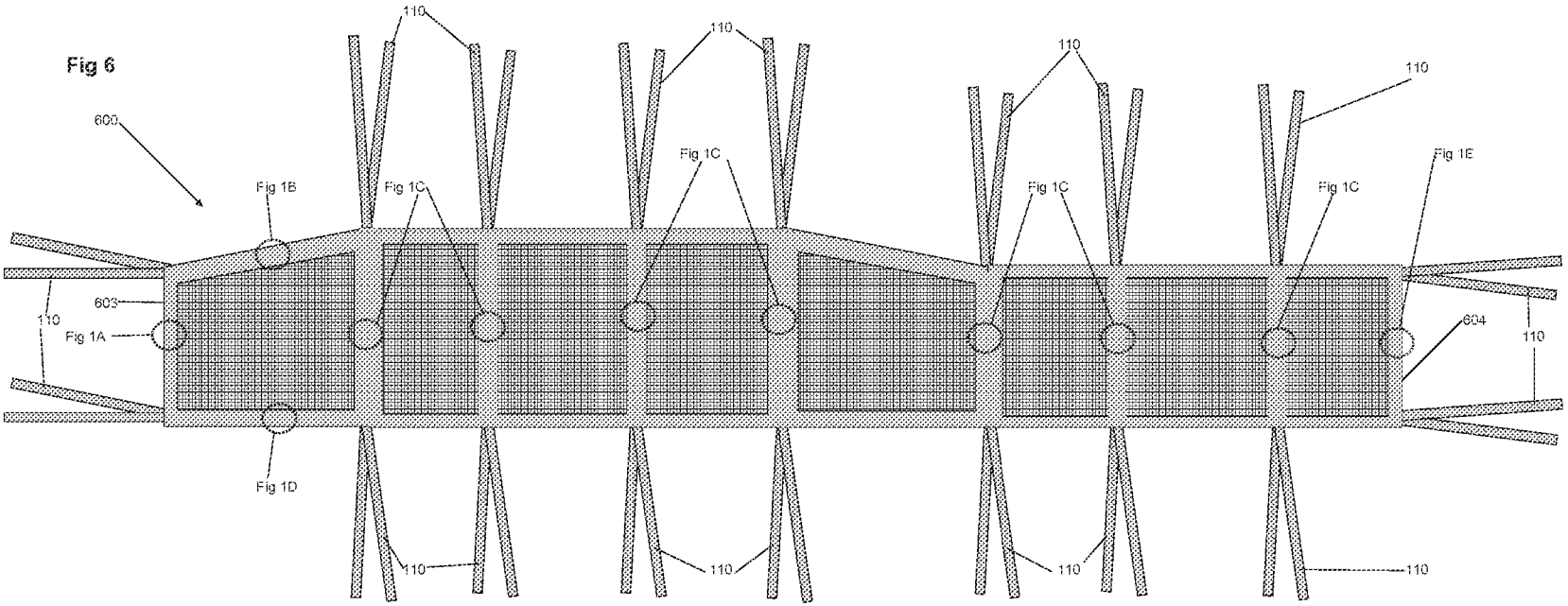
FIG. 6 is a front view of a continuous crib liner in accordance with this invention.

In another embodiment as shown in FIG. 6, the crib liner may be a continuous crib liner 600 that connects together at the side ends of the panels. The crib liner 600 shown in FIG. 6 is depicted shown disconnected from the ends of the crib liner 603, 604. However, the ends of the crib liner 603, 604 may be secured together to form a single continuous crib liner. Each panel is provided with at least one, but preferably with a plurality of stabilizers, which may be located along the periphery of each individual panel comprising the plurality of panels. The panels of the crib liner may be sized to fit a crib wall in the shape of a parallelogram. The crib liner may also comprise a platform base configured to connect to the crib liner panels, preferably the bottom of the panes, to form one continuous crib liner that may be placed under a crib mattress and also cover all the walls of a crib.

A crib liner in accordance with this disclosure is not limited to a particular crib size. The crib liner can be sized as necessary to fit a wide array of infant beds, such as cribs, cradles, portable cribs, and so forth.

Another aspect of this invention is a method of lining an infant crib utilizing a crib liner as disclosed herein. The method comprises obtaining a sufficient plurality of crib liners to provide at least one crib liner for each wall of the infant crib. One of the plurality of crib liners is placed parallel to one of the crib walls of the infant crib. The crib liner is secured to the crib walls by at least one fastener, preferably multiple fasteners. The aforementioned steps are repeated until each wall of the infant crib is fitted with a crib liner.

Any reference to patents, documents and other writings contained herein shall not be construed as an admission as to their status with respect to being or not being prior art. It is understood that the array of features and embodiments taught herein may be combined and rearranged in a large number of additional combinations not directly disclosed, as will be apparent to one having skill in the art.

There are, of course, other alternate embodiments, which are obvious from the foregoing descriptions of the invention, which are intended to be included within the scope of the invention, as defined by the following claims.

What is claimed is:

1. A crib liner comprising:

a. at least one panel having a top side and a bottom side;

b. at least one vertical stabilizer, wherein said vertical stabilizer is positioned substantially orthogonal to the top side and bottom side of the panel and secured to the panel by a pocket, wherein said pocket and stabilizer are located in the same area along the periphery of said panel;

c. at least one horizontal stabilizer positioned substantially parallel to the top side and bottom side of the panel, wherein said horizontal stabilizer is secured to the panel by a pocket extending along the top side or the bottom side of the panel;

d. a perforated section; and, e. at least one fastener.

2. The crib liner of claim 1, wherein each panel further comprises a cushioned section, wherein said cushioned section is secured to said perforated section such that said cushioned section is parallel to said perforated section, wherein said cushioned section further comprises a layer of fabric over a plush material.

3. The crib liner of claim 1, wherein said crib liner is removably and securely attachable to the crib by said fastener.

4. The crib liner of claim 1, wherein said vertical stabilizer is enclosed within said pocket, wherein said pocket traverses the panel from the top side to the bottom side of the panel.

5. The crib liner of claim 1, wherein said crib liner is continuous.

6. A method of lining the walls of a crib comprising:

a. obtaining a plurality of crib liners such that said plurality of crib liners is sufficient to provide at least one crib liner for each wall of said crib, wherein said plurality of crib liners comprises:

i. a plurality of panels, wherein each panel further comprises a top edge, a bottom edge and a perforated section, wherein said top edge is substantially parallel to said bottom edge;

ii. a plurality of vertical stabilizers, wherein said plurality of vertical stabilizers separates the plurality of panels into individual panels, wherein said vertical stabilizers are secured to the panel by pockets extending from the top edge to the bottom edge of the panel, wherein said pockets and plurality of vertical stabilizers are located in the same area along the periphery of said individual panels;

iii. at least one horizontal stabilizer positioned substantially parallel to the top edge and bottom edge of the panel, wherein said horizontal stabilizer is secured to the panel by a pocket extending along the top edge or the bottom edge of the panel iv. a perforated section; and, v. at least one fastener, b. placing one of said plurality of crib liners parallel to one of said walls of said crib, c. securing said liner to said wall utilizing said at least one fastener; and d. repeating above steps until each of said walls is fitted with said crib liner.

7. The method of claim 6, wherein each said plurality of panels further comprises a cushioned section, wherein said cushioned section is secured to said perforated section such that said cushioned section is parallel to said perforated section, wherein said cushioned section further comprises a layer of fabric over a plush material.

8. The method of claim 6, wherein said plurality of stabilizers are enclosed within said pockets.

* * * * *